US009914300B2

(12) United States Patent
Hamaguchi et al.

(10) Patent No.: US 9,914,300 B2
(45) Date of Patent: Mar. 13, 2018

(54) HEAD AND LIQUID EJECTING APPARATUS WITH ELECTRICALLY CONNECTING BUMPS

(71) Applicant: SEIKO EPSON CORPORATION, Tokyo (JP)

(72) Inventors: Toshiaki Hamaguchi, Fujimi-machi (JP); Eiju Hirai, Minowa-machi (JP); Yoichi Naganuma, Matsumoto (JP); Motoki Takabe, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/060,114

(22) Filed: Mar. 3, 2016

(65) Prior Publication Data

US 2016/0271948 A1 Sep. 22, 2016

(30) Foreign Application Priority Data

Mar. 16, 2015 (JP) ..... 2015-051804

(51) Int. Cl.
*B41J 2/14* (2006.01)

(52) U.S. Cl.
CPC .. *B41J 2/14233* (2013.01); *B41J 2002/14241* (2013.01); *B41J 2002/14491* (2013.01)

(58) Field of Classification Search
CPC ..... B41J 2/14233
See application file for complete search history.

(56) References Cited

U.S. PATENT DOCUMENTS

| | | | | |
|---|---|---|---|---|
| 7,351,649 | B2 | 4/2008 | Shinkai | |
| 2005/0239233 | A1* | 10/2005 | Shinkai | B41J 2/14209 438/106 |
| 2009/0237454 | A1* | 9/2009 | Kanemoto | B41J 2/14233 347/47 |
| 2013/0147881 | A1* | 6/2013 | Redding | B41J 2/14233 347/71 |
| 2014/0092167 | A1* | 4/2014 | Nishi | B41J 2/14233 347/20 |

FOREIGN PATENT DOCUMENTS

| | | |
|---|---|---|
| JP | 2009-078564 | 4/2009 |
| JP | 2014-051008 | 3/2014 |

* cited by examiner

*Primary Examiner* — Bradley Thies
(74) *Attorney, Agent, or Firm* — Workman Nydegger

(57) ABSTRACT

A head including a channel formation substrate is provided with a pressure generating chamber which communicates with a nozzle for ejecting a liquid; a piezo element includes a first electrode which is provided on one surface side of a channel formation substrate, a piezoelectric layer is provided on the first electrode, and a second electrode is provided on the piezoelectric layer; and a driving circuit board is bonded to the one surface side of the channel formation substrate via an adhesive layer, and is provided with a driving circuit for driving the piezo element, in which the piezo element and the driving circuit are electrically connected to each other via a bump which is provided on any one of the channel formation substrate and the driving circuit board, and in which the bump and the adhesive layer are provided above the piezoelectric layer of the piezo element.

10 Claims, 8 Drawing Sheets

HEAD AND LIQUID EJECTING APPARATUS WITH ELECTRICALLY CONNECTING BUMPS

The entire disclosure of Japanese Patent Application No: 2015-051804, filed Mar. 16, 2015 is expressly incorporated by reference herein in its entirety.

BACKGROUND

1. Technical Field

The present invention relates to a head which ejects a liquid, and a liquid ejecting apparatus which is provided with the head, and particularly relates to an ink jet recording head and an ink jet type recoding apparatus which eject ink as the liquid.

2. Related Art

A piezo ink jet system is an on-demand type ink jet printing system which discharges a liquid droplet by deforming a piezo element through the applying of a voltage to the piezo element (JIS Z8123-1: 2013).

A permanent head is a machine portion or an electrical portion of a printer main body which continuously or intermittently generates a liquid droplet of ink (JIS Z8123-1: 2013).

The permanent head (hereinafter, referred to as a "head") which is used in the piezo ink jet system is provided with a channel formation substrate on which a pressure generating chamber, which communicates with a nozzle for ejecting a liquid droplet is formed, a piezo element which is provided on one surface side of the channel formation substrate, and a driving circuit board in which a driving circuit, which is bonded onto the channel formation substrate so as to be close to the piezo element and drives the piezo element is provided. The permanent head ejects the liquid droplet from the nozzle by driving the piezo element by the driving circuit and applying a pressure change to the liquid in the pressure generating chamber.

As the piezo element described above, a thin-film type piezo element which is formed on the channel formation substrate through a film formation method and a lithography method has been proposed. When using such a thin-film type piezo element, it is possible to dispose the piezo element at high density; however, it is difficult to electrically connect the piezo element which is disposed at high density and the driving circuit.

For this reason, there have been suggested a configuration such that a bump is provided on the driving circuit board, and the driving circuit and the piezo element are electrically connected to each other via the bump (for example, JP-A-2014-51008).

In this way, by using the bump for connection between the driving circuit and the piezo element, it is possible to ensurely connect the piezo element which is disposed at high density and the driving circuit at low cost.

In addition, the driving circuit board and the channel formation substrate are bonded to each other via an adhesive layer which is provided around the bump. The bump and the adhesive layer have a certain height, and a holding portion which is a space for accommodating a piezo element is formed between the driving circuit board and the channel formation substrate.

However, there is a problem in that if the holding portion does not have sufficient height, the piezo element is displaced and comes in contact with the driving circuit board such that the displacement of the piezo element is disturbed. In addition, it is considered that the height of the bump and the adhesive layer is set to be larger than a certain height so as to secure the sufficient height of the holding portion; however, since it is difficult to maintain the strength, there is a limit to the height of the bump and the adhesive layer.

Further, when the height of the bump and the adhesive layer is set to be larger than a certain height so as to secure the height of the holding portion, the width of the bump and the adhesive layer is required to be larger, and a space for disposing the bump and the adhesive layer is also required, which brings about a problem in that the driving circuit board is enlarged.

In addition, when the holding portion does not have the sufficient height, there is a concern in that discharge is likely to occur due to a potential difference generated between the wirings which are provided on each of the driving circuit board and the channel formation substrate, and thus the driving circuit and the piezo element are destroyed.

Note that such a problem exists in not only an ink jet recording head, but also a head for ejecting liquid droplets other than the ink.

SUMMARY

An advantage of some aspects of the invention is to provide a head and liquid ejecting apparatus with improved reliability which do not disturb displacement of a piezo element and prevent the piezo element from being electrically destroyed.

According to an aspect of the invention, there is provided a head including a channel formation substrate that is provided with a pressure generating chamber which communicates with a nozzle for ejecting a liquid; a piezo element that includes a first electrode which is provided on one surface side of a channel formation substrate, a piezoelectric layer which is provided on the first electrode, and a second electrode which is provided on the piezoelectric layer; and a driving circuit board that is bonded to the one surface side of the channel formation substrate via an adhesive layer, and is provided with a driving circuit for driving the piezo element, in which the piezo element and the driving circuit are electrically connected to each other via a bump which is provided on any one of the channel formation substrate and the driving circuit board, and the bump and the adhesive layer are provided above the piezoelectric layer of the piezo element.

According to the aspect, it is possible to widen a gap between the channel formation substrate and the driving circuit board by providing the bump and the adhesive layer above the piezoelectric layer. With this, it is possible to prevent the piezo element from coming in contact with the driving circuit board when the piezo element is displaced. In addition, it is possible to widen the gap between the channel formation substrate and the driving circuit board without setting the height of the bump and the adhesive layer to be higher than a certain height, and thus the width of the bump and the adhesive layer is not required to be larger, thereby realizing the size reduction. Further, since it is possible to widen the gap between the channel formation substrate and the driving circuit board, it is possible to suppress the discharge occurring due to a potential difference generated between the wirings which are provided on each of the driving circuit board and the channel formation substrate, and thereby to prevent the driving circuit and the piezo element from being destroyed.

Here, it is preferable that the first electrode, the second electrode, and a lead-out wiring which is drawn from the first electrode or the second electrode are provided on the piezoelectric layer on which the bump is provided, and the bump, the first electrode, the second electrode, and a lead-out wiring which is drawn from the first electrode or the second electrode are electrically connected to each other. With this, it is possible to ensurely connect the driving circuit and the piezo element via the bump.

In addition, it is preferable that the adhesive layer is formed of a photosensitive resin. With this, it is possible to easily form the adhesive layer in a predetermined shape with high accuracy.

In addition, it is preferable that the bump includes a core portion having elastic properties, and a metallic film which is provided on a surface of the core portion. With this, even though the warpage and undulation occur on the driving circuit board or the channel formation substrate, the core portion of the bump is deformed in accordance with the warpage and undulation, and thus it is possible to ensurely connect the bump and the piezo element.

According to another aspect of the invention, there is provided a head including a channel formation substrate that is provided with a pressure generating chamber which communicates with a nozzle for ejecting a liquid; a piezo element that includes a first electrode which is provided on one surface side of a channel formation substrate, a piezoelectric layer which is provided on the first electrode, and a second electrode which is provided on the piezoelectric layer; and a driving circuit board that is bonded to the one surface side of the channel formation substrate via an adhesive layer, and is provided with a driving circuit for driving the piezo element, in which the piezo element and the driving circuit are electrically connected to each other via a bump which is provided on any one of the channel formation substrate and the driving circuit board, and the bump and the adhesive layer are provided on the same plane on the one surface side of the channel formation substrate.

According to the aspect, by providing the bump and the adhesive layer on the same plane on the one surface side of the channel formation substrate, it is possible to ensurely electrically connect the bump and the adhesive layer with a relatively small load, and thus to suppress the deformation and destruction due to the load of the channel formation substrate. In addition, it is possible to improve the long-term reliability of electrical connection.

According to still another aspect of the invention, there is provided a liquid ejecting apparatus including the head described in the above-described aspects.

According to the aspect, it is possible to prevent the displacement of the piezo element from being disturbed, thereby realizing the liquid ejecting apparatus which suppresses the destruction of the piezo element.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments will be described in detail.

Embodiment 1

Figure 1:
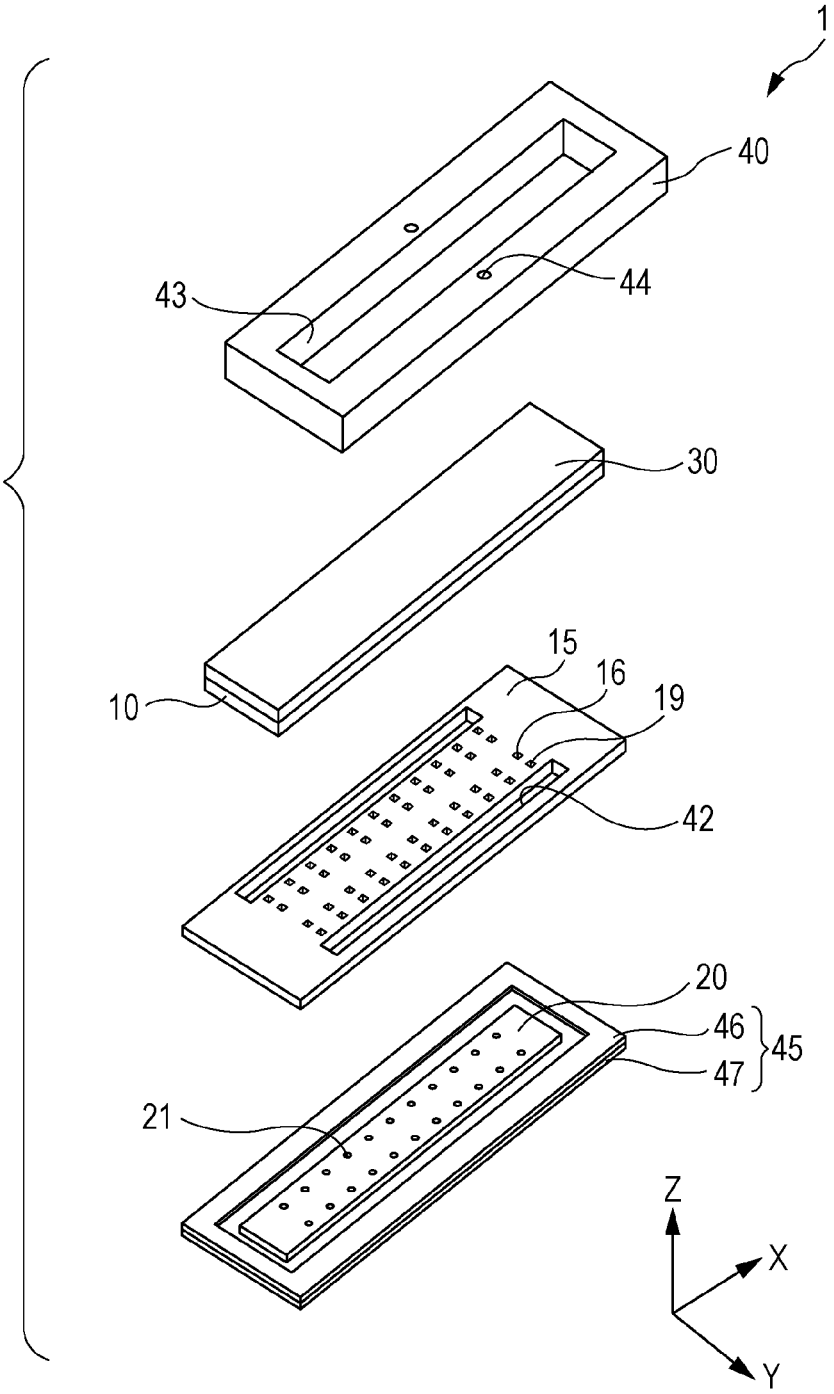
FIG. 1 is an exploded perspective view of a head according to Embodiment 1.
Figure 2:
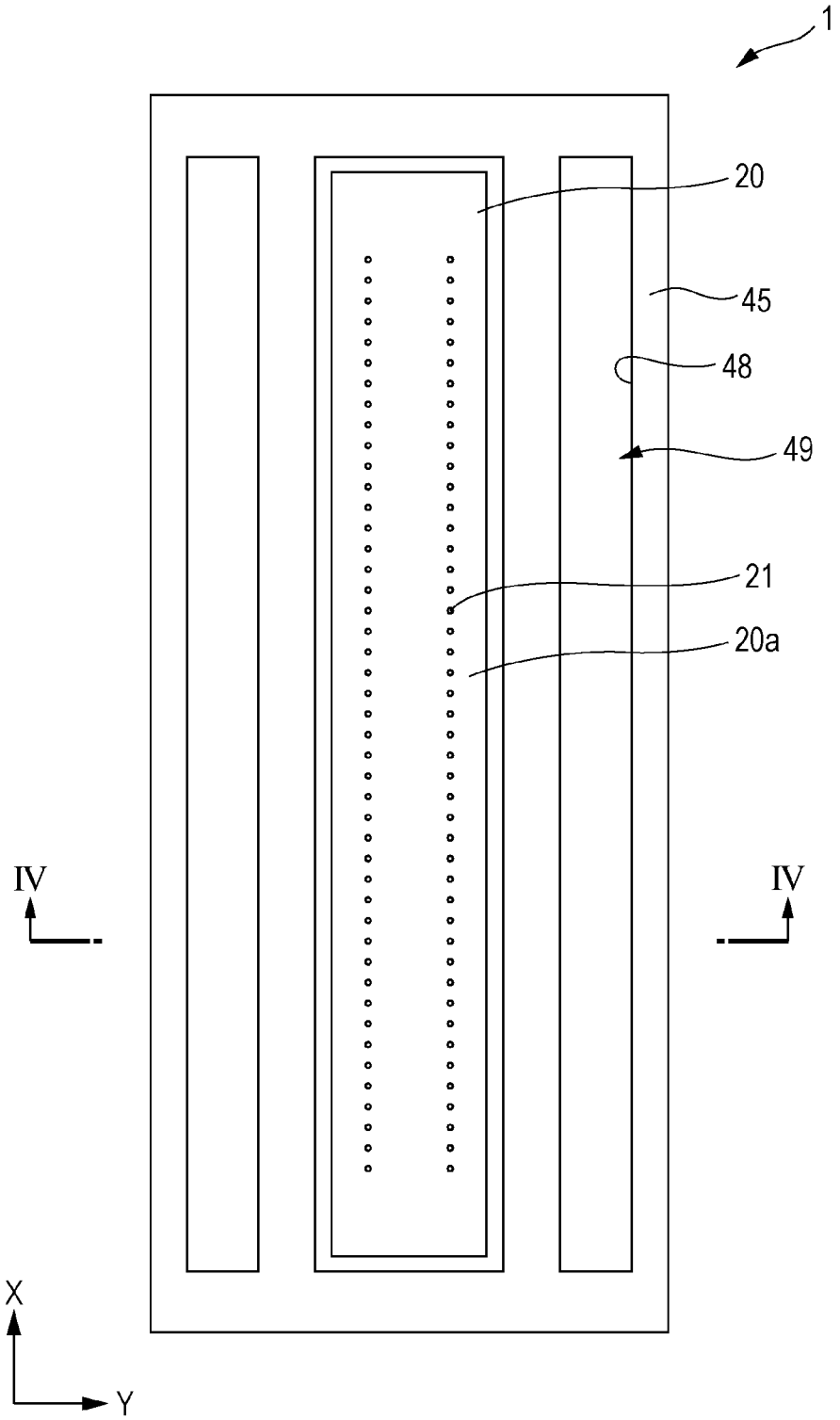
FIG. 2 is a plan view of the head according to Embodiment 1.
Figure 3:
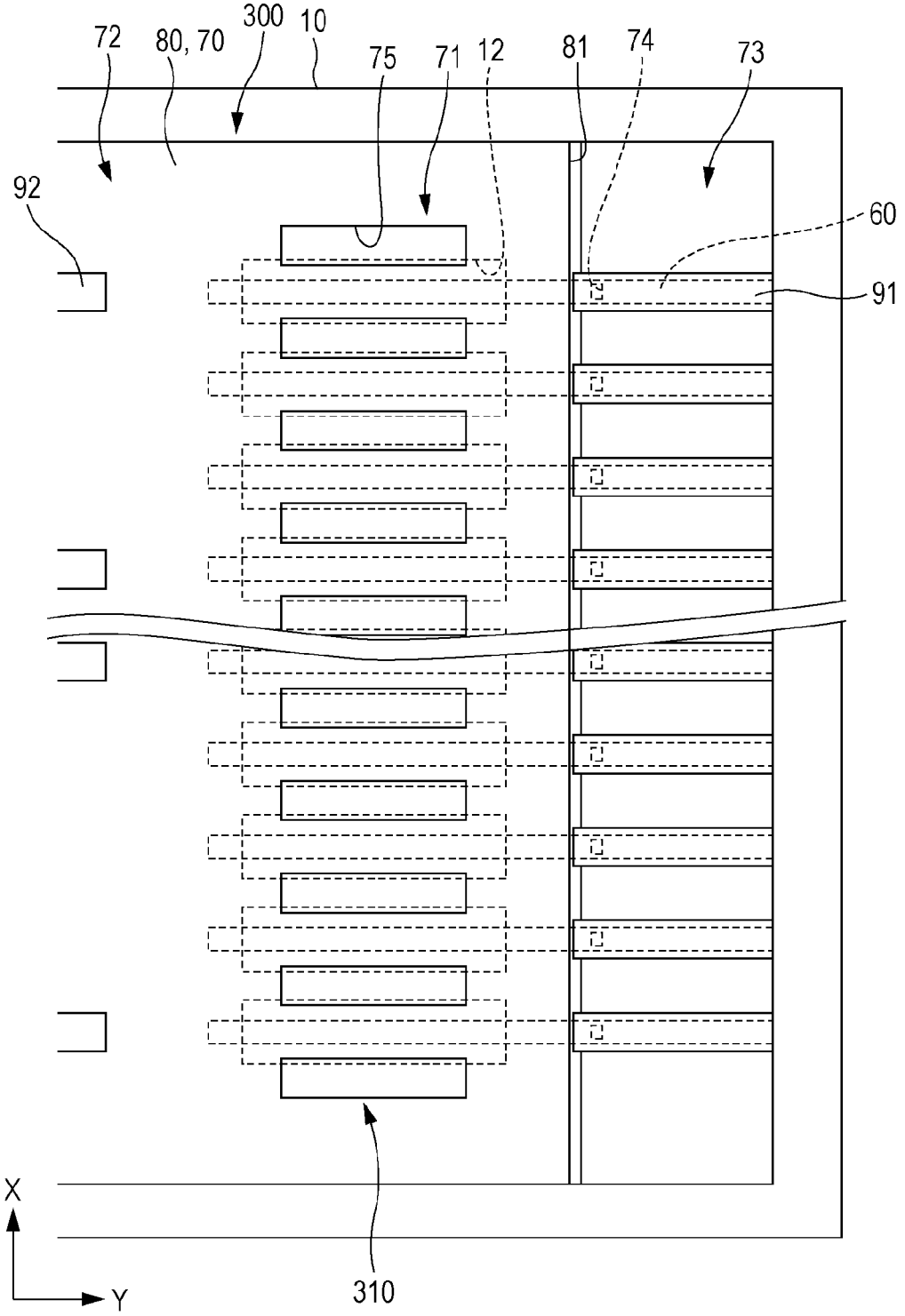
FIG. 3 is a plan view illustrating a main portion of a channel formation substrate according to Embodiment 1.
Figure 4:
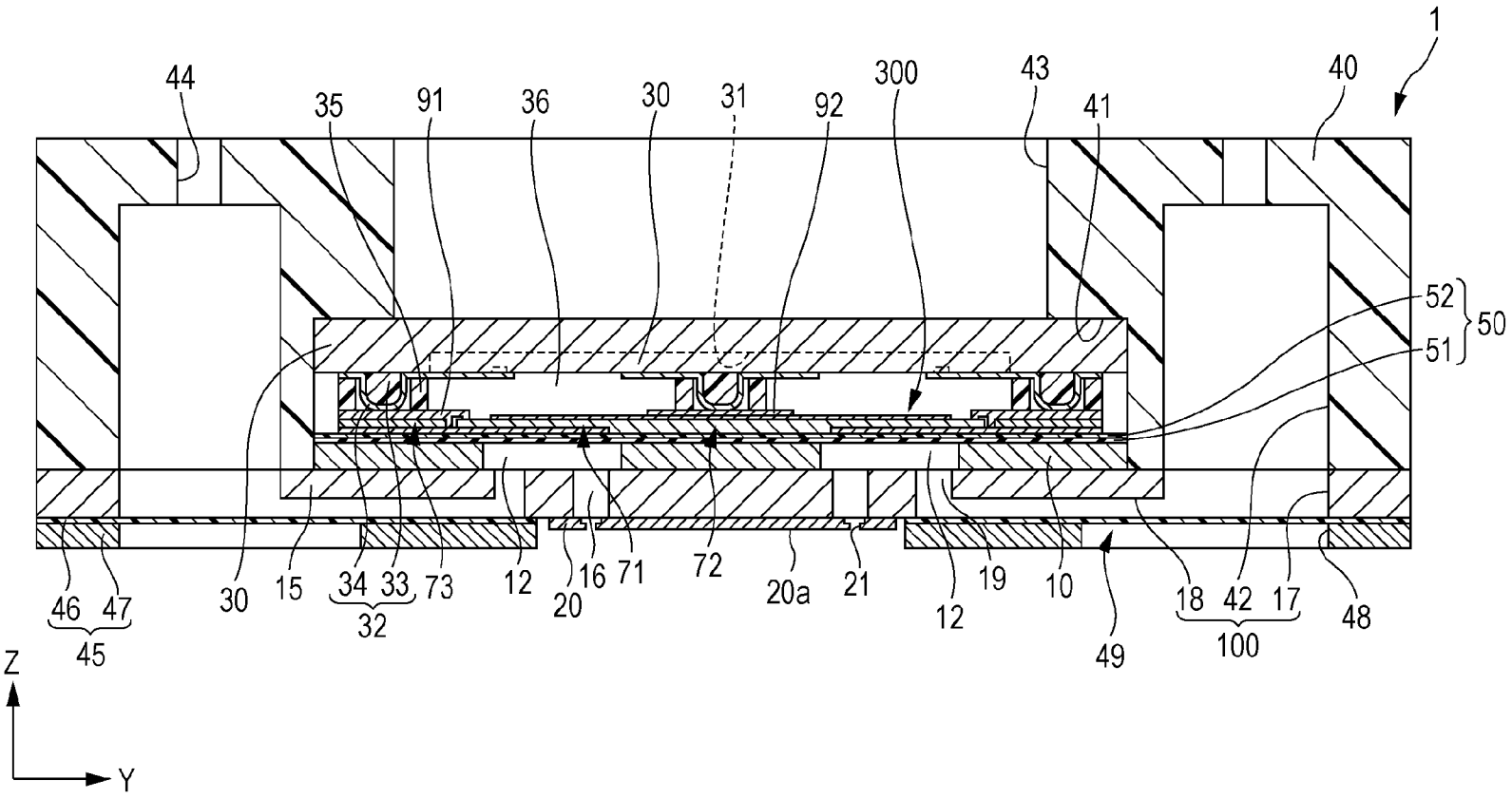
FIG. 4 is a sectional view of the head according to Embodiment 1.
Figure 5:
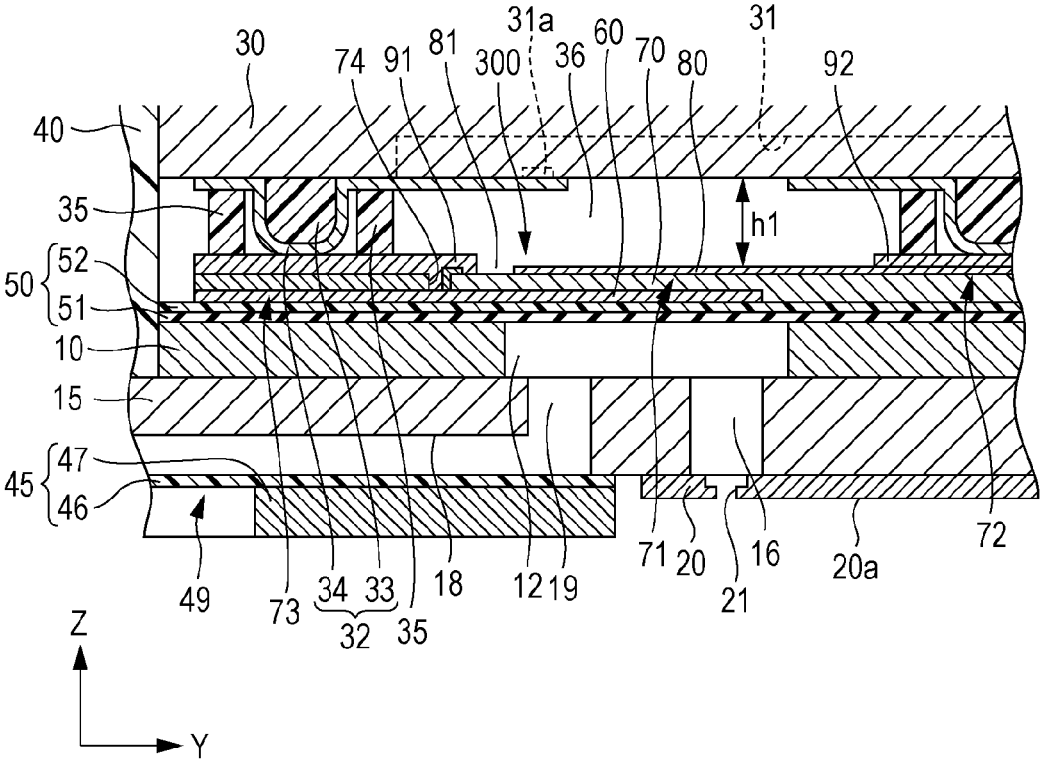
FIG. 5 is an enlarged sectional view of a main portion of the head according to Embodiment 1.

FIG. 1 is an exploded perspective view of an ink jet recording head which is an example of a head according to the Embodiment 1, FIG. 2 is a plan view of the ink jet recording head. In addition, FIG. 3 is a plan view of a channel formation substrate, FIG. 4 is a sectional view taken along line IV-IV in FIG. 2, and FIG. 5 is an enlarged sectional view of a main portion of FIG. 3.

As illustrated in the drawings, the ink jet recording head 1 which is an example of the head in the embodiment is provided with a plurality of members such as a channel formation substrate 10, a communicating plate 15, a nozzle plate 20, a driving circuit board 30, and a compliance board 45.

The channel formation substrate 10 can be formed of, for example, metal such as a stainless steel or Ni, a ceramic material such as $ZrO_2$ or $Al_2O_3$, a glass ceramic material, and an oxide such as an oxide MgO and $LaAlO_3$. In the embodiment, the channel formation substrate 10 is formed of a silicon single crystal substrate. As illustrated in FIG. 4 and FIG. 5, by performing anisotropic etching to the channel formation substrate 10 from one surface side, pressure generating chambers 12 which are partitioned off by a plurality of partition walls are arranged along a direction in which a plurality of nozzles 21 which discharge ink are arranged. Hereinafter, the aforementioned direction is referred to as a juxtaposing direction of the pressure generating chambers 12, or a first direction X. In addition, on the channel formation substrate 10, a plurality of rows of the pressure generating chambers 12 are arranged in the first direction X, and two rows are provided in the embodiment. Hereinafter, a row direction in which a plurality of rows of the pressure generating chambers 12 formed along the first direction X is referred to as a second direction Y. In addition, a direction intersecting with the first direction X and the second direction Y is referred to as a third direction Z in the embodiment. Note that, the directions (X, Y, and Z) are set to be orthogonal to each other in the embodiment; however, components are not limited to be orthogonally disposed.

In addition, on the channel formation substrate 10, for example, a supply path which is smaller than an opening area of the pressure generating chamber 12 and applies a channel resistance to ink flowing into the pressure generating chamber 12 may be provided at one end portion of the pressure generating chamber 12 in the second direction Y.

In addition, on one surface side of the channel formation substrate 10 (a lamination layer direction (a −Z direction)), the communicating plate 15 and the nozzle plate 20 are sequentially laminated. That is, the communicating plate 15 is provided on the one surface of the channel formation substrate 10, and a nozzle plate 20 having nozzles 21 is provided on the surface side opposite to side of the channel formation substrate 10 on which the communicating plate 15 is provided.

The communicating plate 15 is provided with a nozzle communicating path 16 through which the pressure generating chamber 12 and the nozzle 21 communicate with each other. The communicating plate 15 has a larger area than the channel formation substrate 10, and the nozzle plate 20 has a smaller area than the channel formation substrate 10. With such a communicating plate 15 being provided, the nozzle 21 of the nozzle plate 20 and the pressure generating chamber 12 can be separated from each other, and thus the ink in the pressure generating chamber 12 is less likely to be susceptible of thickening due to evaporation of water in the ink occurring in the vicinity of the nozzle 21. In addition, the nozzle plate 20 may only cover openings in the nozzle communicating path 16 through which the pressure generating chamber 12 and the nozzle 21 communicate with each other, and thus it is possible to relatively reduce the area of the nozzle plate 20, and thereby to realize the cost reduction. In addition, in the embodiment, a surface from which is an ink droplet is discharged by opening the nozzle 21 of the nozzle plate 20 is referred to as a liquid ejection surface 20*a*.

In addition, the communicating plate 15 is provided with a first manifold portion 17 and a second manifold portion 18 which form a portion of a manifold 100.

The first manifold portion 17 is provided by passing through the communicating plate 15 in a thickness direction (a direction in which the communicating plate 15 and the channel formation substrate 10 are laminated).

In addition, the second manifold portion 18 is provided by being opened to the nozzle plate 20 side of the communicating plate 15 without passing through the communicating plate 15 in the thickness direction.

In addition, on the communicating plate 15, a supply communicating path 19 which communicates with one end portion of the pressure generating chamber 12 in the second direction Y is independently provided for each pressure generating chamber 12. The second manifold portion 18 and the pressure generating chamber 12 communicate with each other through the supply communicating path 19.

Such a communicating plate 15 can be formed of metal such as a stainless steel or Ni, or ceramics such as zirconium. In addition, the communicating plate 15 is preferably formed of a material having the same linear expansion coefficient as that of the channel formation substrate 10. That is, in a case where a material having a different linear expansion coefficient different from that of the channel formation substrate 10 is used as the communicating plate 15, when heating and cooling the communicating plate 15, a warpage is likely to occur on the communicating plate 15 due to a difference of the linear expansion coefficient between the channel formation substrate 10 and the communicating plate 15. The embodiment is configured such that it is possible to suppress the occurrence of warpage by being heated and cooled, cracks due to heat, or peeling by using a material which is the same as that of the channel formation substrate 10, that is, a silicon single crystal substrate, as the communicating plate 15.

The nozzle 21 which communicates with each of the pressure generating chambers 12 through the nozzle communicating path 16 is formed on the nozzle plate 20. Such nozzles 21 are arranged in the first direction X, and two rows of the nozzles 21, each of which is formed of the nozzles 21 arranged in the first direction X, are formed in the second direction Y.

As such a nozzle plate 20, it is possible to use, for example, metal such as a stainless steel (SUS), an organic material such as a polyimide resin, and a silicon single crystal substrate. In addition, when using the silicon single crystal substrate as the nozzle plate 20, the linear expansion coefficient between the nozzle plate 20 and the communicating plate 15 is the same, and thus it is possible to suppress the occurrence of the warpage by being heated and cooled, cracks due to heat, or peeling.

On the other hand, a vibrating plate 50 is formed on the surface side opposite to side of the channel formation substrate 10 on which the communicating plate 15 is provided. In the embodiment, as the vibrating plate 50, an elastic film 51 which is provided on the channel formation substrate 10 side and is formed of a silicon oxide and an insulator film 52 which is provided on the elastic film 51, and is formed of a zirconium oxide. In addition, a liquid flow path such as the pressure generating chamber 12 is formed by performing the anisotropic etching on the channel formation substrate 10 from one surface side (from the surface to which the nozzle plate 20 is bonded) of the liquid flow path, and the other surface of the liquid flow path such as the pressure generating chamber 12 is partitioned by the elastic film 51.

In addition, a piezoelectric actuator 300 which is a piezo element of the embodiment is provided on the vibrating plate 50 of the channel formation substrate 10. The piezoelectric actuator 300 includes a first electrode 60, a piezoelectric layer 70, and a second electrode 80 which are sequentially laminated from the vibrating plate 50 side. The first electrodes 60 which form the piezoelectric actuator 300 are cut and divided for each pressure generating chamber 12 so as to form an individual electrode for each piezoelectric actuator 300, as illustrated in FIG. 3. Here, the piezoelectric actuator 300 which is formed of the first electrode 60, the piezoelectric layer 70, and the second electrode 80, is displaced by applying a voltage between the first electrode 60 and the second electrode 80. That is, when the voltage is applied between both electrodes, piezoelectric strain occurs in the piezoelectric layer 70 which is pinched between the first electrode 60 and the second electrode 80. In addition, at the time of applying the voltage to both electrodes, a portion of the piezoelectric layer 70 in which the piezoelectric strain occurs is referred to as an active portion 71. In contrast, a portion of the piezoelectric layer 70 in which the piezoelectric strain does not occur is referred to as a non-active portion. In other words, in the embodiment, the active portion 71 is provided for each pressure generating chamber 12, and thus on the channel formation substrate 10, two rows of the active portions 71, each of which is formed of the active portions 71 provided a line in the first direction X, are provided in the second direction Y.

In the embodiment, the first electrode 60 is cut and divided for each pressure generating chamber 12, and forms the individual electrode for each active portion 71.

Such a first electrode 60 is formed with a smaller width than the pressure generating chamber 12 in the first direction X of the pressure generating chamber 12. That is, in the first direction X of the pressure generating chamber 12, an end portion of the first electrode 60 is positioned on the inner side of an area facing the pressure generating chamber 12. In addition, in the second direction Y, one end side of the first electrode 60 on the nozzle 21 side is provided on the inside of an area facing the pressure generating chamber 12, and the other end side of the first electrode 60 on the manifold 100 side is extended to the outside of the pressure generating chamber 12. In addition, the other end side of the first electrode 60 on the manifold 100 side is extended to the vicinity of an end portion of the channel formation substrate 10 in the second direction Y in the embodiment. That is, the first electrode 60 in each of the active portion provided on one side in the second direction Y is extended to the vicinity of an end portion of the channel formation substrate 10 on the one side of the second direction. In contrast, the first electrode 60 in each active portion provided on the other side in the second direction Y is extended to the vicinity of the end portion of the channel formation substrate 10 on the other side of the second direction Y.

The piezoelectric layer 70 is continuously provided in the first direction X such that the second direction Y becomes a predetermined width. The width of the piezoelectric layer 70 in the second direction Y is larger than the width of the pressure generating chamber 12 in the second direction Y. For this reason, in the second direction Y of the pressure generating chamber 12, the piezoelectric layer 70 is extended to the outside of the pressure generating chamber 12. In the embodiment, the piezoelectric layer 70 is continuously provided throughout the two active portion rows. That is, the piezoelectric layer 70 in the embodiment is continuously provided throughout the active portion rows arranged in the first direction X, and is continuously provided throughout the two active portion rows arranged in the second direction Y. Note that, in the embodiment, in the second direction Y, the non-active portion between the two active portion rows is referred to as a first non-active portion 72. In addition, similar to the first electrode 60, the piezoelectric layer 70 is extended to the end portion of the channel formation substrate 10 in the second direction Y. In the embodiment, the non-active portion which is provided on the manifold 100 side from the active portion 71 of the piezoelectric layer 70 is referred to as a second non-active portion 73. Further, a contact hole 74 which passes through the piezoelectric layer 70 in the third direction Z, and exposes the first electrode 60 is provided in the second non-active portion 73 of the piezoelectric layer 70. In the embodiment, the contact hole 74 is provided for each first electrode 60.

The piezoelectric layer 70 is formed of a piezoelectric material such as an oxide having a polarization structure which is formed on the first electrode 60, and can be formed of, for example, a perovskite type oxide expressed by a general formula of $ABO_3$. As the perovskite type oxide used for the piezoelectric layer 70, for example, a lead based piezoelectric material including lead or a non-lead based piezoelectric material which does not include the lead can be used.

In addition, the piezoelectric layer 70 is provided with a recessed portion 75 corresponding to each of the partition walls. The width of the recessed portion 75 in the first direction X is substantially the same as or larger than the width of each partition wall in the first direction X. With this, rigidity of a portion (a so-called arm portion of the vibrating plate 50) corresponding to the end portion of the pressure generating chamber 12 in the second direction Y of the vibrating plate 50 is suppressed, and thus the piezoelectric actuator 300 can be favorably displaced.

The second electrode 80 is provided on the surface opposite to the surface of the piezoelectric layer 70 on which the first electrode 60 is provided, and forms a common electrode which is common to a plurality of the active portions 71. In addition, the second electrode 80 may be or may not be formed on the inner surface of the recessed portion 75, that is, on the surface side of the recessed portion 75 of the piezoelectric layer 70. In the embodiment, the second electrode 80 which is provided for each row of the active portions 71 arranged in the first direction X is continuously provided on the first non-active portion 72. Specifically, on the surface opposite to the first electrode 60 of the piezoelectric layer 70 in the embodiment, the second electrode 80 is provided throughout areas except for the second non-active portion 73 of the piezoelectric layer 70, that is, on the active portion 71 and the first non-active portion 72 of the piezoelectric layer 70, on the surface side of the active portion 71 side of the inside of the contact hole 74, and on the first electrode 60 which is exposed to the contact hole 74. In addition, the second electrode 80 on the first electrode 60 and the second electrode 80 in a main portion of the piezoelectric layer 70, that is, the second electrode 80 on the active portion 71 are electrically disconnected from each other by a removing portion 81 in which the first electrode 60 is completely removed in the thickness direction. That is, the second electrode 80 which is provided in the contact hole 74, and the second electrode 80 which is provided in a main portion of the piezoelectric layer 70 are formed of the same layer, but are electrically disconnected. In the embodiment, such a removing portion 81 is continuously provided throughout the piezoelectric layer 70 on the manifold 100 side in the first direction X, as illustrated in FIG. 3.

With such a configuration, in the embodiment, an end portion of the active portion 71 in the first direction X is defined by the first electrode 60. In addition, an end portion of the first electrode 60 in the first direction X is provided in an area facing the pressure generating chamber 12. In addition, an end portion of the active portion 71 on the nozzle 21 side in the second direction Y is defined by the first electrode 60. Further, the end portion the active portion 71 on the manifold 100 side in the second direction Y is defined by the second electrode 80.

In addition, an individual wiring 91 which is a lead-out wiring is drawn out from the first electrode 60 of the piezoelectric actuator 300. In the embodiment, the individual wiring 91 is provided on the second non-active portion 73 of the piezoelectric layer 70, and is electrically connected to the first electrode 60 in the contact hole 74.

In addition, a common wiring 92 which is the lead-out wiring is drawn out from the second electrode 80 of the piezoelectric actuator 300. In the embodiment, the common wiring 92 is formed on the second electrode 80 on the first non-active portion 72. In addition, one common wiring 92 is provided with respect to the plurality of active portions 71 in the first direction X.

The driving circuit board 30 having substantially the same size as that of the channel formation substrate 10 is bonded onto the surface of the piezoelectric actuator 300 side of the channel formation substrate 10.

Figure 6:
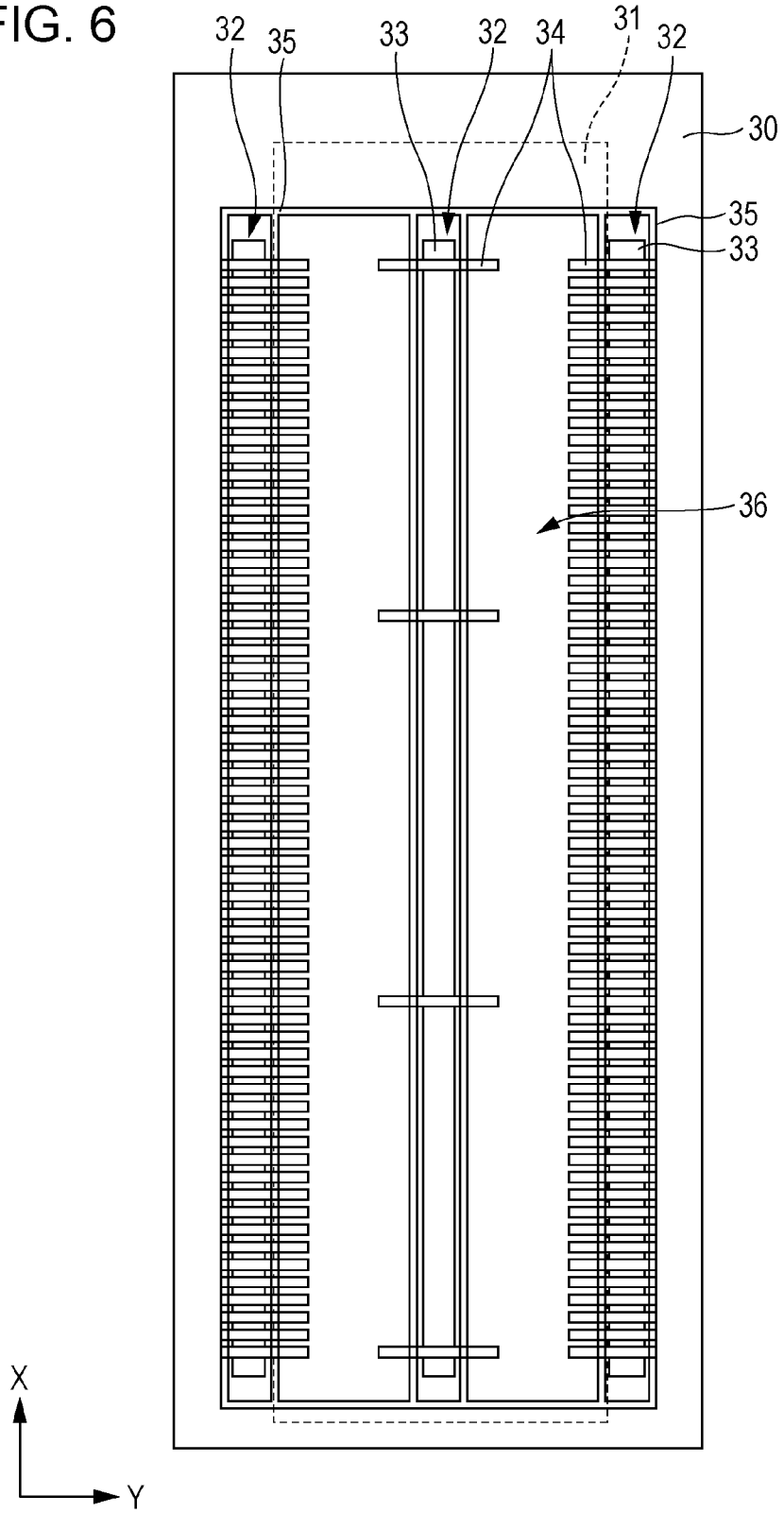
FIG. 6 is a plan view of the driving circuit board according to Embodiment 1.

Here, the driving circuit board 30 will be described with reference to FIG. 4, FIG. 5, and FIG. 6. Meanwhile, FIG. 6 is a plan view of a driving circuit board according to the Embodiment 1.

As illustrated in the drawings, the driving circuit board 30 in the embodiment is obtained by forming the driving circuit 31 which is an integrated circuit on the semiconductor substrate through a semiconductor manufacturing process, for example, the driving circuit board 30 is not obtained by being mounted on the wiring with a semiconductor integrated circuit being provided on the substrate.

Such a driving circuit board 30 is integrally formed on the surface side on which the driving circuit 31 and the channel formation substrate 10 face each other. In addition, the driving circuit board 30 and the channel formation substrate 10 are bonded to each other via an adhesive layer 35.

Here, the driving circuit 31 of the driving circuit board 30 and the individual wiring 91 and the common wiring 92 of the channel formation substrate 10 are connected to each other via the bump 32. In the embodiment, the bump 32 which is electrically connected to each terminal 31*a* of the driving circuit 31 is provided on the surface of the driving circuit board 30, which is opposite to the surface facing the channel formation substrate 10, the bump 32, and the individual wiring 91 and the common wiring 92 are electrically connected to each other via the bump 32, and thus the driving circuit 31, and the first electrode 60 and the second electrode 80 of the piezoelectric actuator 300 are electrically connected to each other.

Such a bump 32 is provided with, for example, a core portion 33 which is formed of a resin material having elastic properties, and a metallic film 34 which is formed on the surface of the core portion 33.

The core portion 33 is formed of a photosensitive insulating resin or a thermosetting insulating resin such as a polyimide resin, an acrylic resin, a phenol resin, a silicone resin, a silicone-modified polyimide resin, and an epoxy resin.

In addition, the core portion 33 is formed into a substantially semispherical shape before the driving circuit board 30 and the channel formation substrate 10 are bonded to each other. Here, the semispherical shape means a columnar shape of which an inner surface (a bottom surface) coming in contact with the driving circuit board 30 is a flat surface and an outer surface side which is a non-contact surface is a curved surface. Specifically, the substantially semispherical shape includes a case where a cross-section is formed into a substantially semicircle shape, a substantially semielliptical shape, or a substantially trapezoid shape.

In addition, when the core portion 33 is compressed such that the driving circuit board 30 and the channel formation substrate 10 are relatively close to be each other, a distal end shape thereof is elastically deformed as the surface shape of the individual wiring 91 and the common wiring 92.

With this, even though the warpage and undulation occur on the driving circuit board 30 or the channel formation substrate 10, the core portion 33 is deformed in accordance with the warpage and undulation, and the bump 32, and the individual wiring 91 and the common wiring 92 can be surely connected to each other.

In addition, in the embodiment, the core portion 33 is continuously disposed in a linear manner in the first direction X. That is, in addition, total of three core portions 33 are provided in such a manner that two core portions 33 are provided on the outside of two rows of piezoelectric actuator 300, and one core portion 33 is provided between two rows of piezoelectric actuator 300 in the second direction Y. Further, each of the core portions 33 which are provided on the outside of the two rows of piezoelectric actuator 300 forms the bump 32 connected to the individual wiring 91 of the row of piezoelectric actuator 300, and the core portion 33 which is provided between two rows of piezoelectric actuator 300 forms the bump 32 connected to the common wiring 92 of the two rows of piezoelectric actuator 300.

Such a core portion 33 can be formed by using photolithography technique and etching technique.

The metallic film 34 covers the surface of the core portion 33. The metallic film 34 is formed of metal, for example, Au, TiW, Cu, Cr (chrome), Ni, Ti, W, NiV, Al, Pd (palladium), and a lead-free solder, or an array, and these may be a single layer or a multiple layer. In addition, the metallic film 34 is deformed as the surface shape of the individual wiring 91 and the common wiring 92 due to the elastically deformed core portion 33, and is metallically bonded to the individual wiring 91 and the common wiring 92. In addition, the metallic film 34 which is connected to the individual wiring 91 is provided on the surface of the core portion 33 at the same pitch as that of the individual wiring 91 in the first direction X. In addition, the metallic film 34 which is connected to the common wiring 92 is provided on the surface of the core portion 33 at the same pitch as that of the common wiring 92 in the first direction X.

Such a bump 32, in the embodiment, the metallic film 34 which is provided on the surface of the core portion 33, and the individual wiring 91 and the common wiring 92 are bonded to each other at a normal temperature. Specifically, the driving circuit board 30 and the channel formation substrate 10 in the embodiment are bonded to each other via the adhesive layer 35, and the bump 32, and the individual wiring 91 and the common wiring 92 are fixed to each other while coming in contact with each other. Here, examples of the adhesive layer 35 include an adhesive or a resist material such as an epoxy resin, an acrylic resin, and a silicone resin. Particularly, it is possible to easily form the adhesive layer 35 with high accuracy by using the photosensitive resin used in a photoresist or the like.

In the embodiment, the adhesive layer 35 is provided on the both sides of each bump 32, that is, on the both sides with the bump 32 interposed therebetween in the second direction Y. That is, three bumps 32, each of which is extended in the first direction X, are provided in the second direction Y, and thus the adhesive layer 35 is extended on the both sides of each bump 32 in the second direction Y along the first direction X. That is, six adhesive layers 35, each of which is extended in the first direction X, are provided in the second direction Y. In addition, the adhesive layers 35 which are arranged in the second direction Y are provided such that end portions thereof are continuous at both end portions in the first direction X. That is, the adhesive layer 35 is formed so as to cover around each row of the piezoelectric actuator 300, and is formed into a rectangular frame shape so as to surround each row of the piezoelectric actuator 300 in a planar view.

As described above, a holding portion 36 which is a space in which the piezoelectric actuator 300 is disposed is formed between the channel formation substrate 10 and the driving circuit board 30 by the adhesive layer 35 bonding the channel formation substrate 10 and the driving circuit board 30. In the embodiment, the adhesive layer 35 is continuously provided to cover around each row of the piezoelectric actuator 300, and thus the holding portion 36 corresponding to each row of the piezoelectric actuator 300 is independently provided between the channel formation substrate 10 and the driving circuit board 30.

In this way, the bump 32 which electrically connects each electrode of the piezoelectric actuator 300 and the driving circuit 31, and the adhesive layer 35 which bonds the channel formation substrate 10 and the driving circuit board 30 are provided above the piezoelectric layer 70 in the embodiment.

Specifically, the bump 32 which is connected to the individual wiring 91 and the adhesive layer 35 which is provided corresponding to the bump 32 are provided on the second non-active portion 73 of the piezoelectric layer 70 via the individual wiring 91. That is, the individual wiring 91, and the bump 32 and the adhesive layer 35 are bonded to each other on the second non-active portion 73 of the piezoelectric layer 70.

In addition, the bump 32 which is connected to the common wiring 92 and the adhesive layer 35 which is provided corresponding to the bump 32 are provided via the common wiring 92 provided on the second electrode 80 and the second electrode 80 which are provided on the first non-active portion 72 of the piezoelectric layer 70. That is, the common wiring 92, and the bump 32 and the adhesive layer 35 are bonded to each other on the first non-active portion 72 of the piezoelectric layer 70.

That is, a state where the bump 32 and the adhesive layer 35 are provided above the piezoelectric layer 70 means that the bump 32 and the adhesive layer 35 are provided on the surface opposite to the channel formation substrate 10 of the piezoelectric layer 70 in the third direction Z which is a lamination direction of the channel formation substrate 10 and the driving circuit board 30. In addition, a phrase "above the piezoelectric layer 70" includes a state where other materials such as an electrode such as the second electrode 80, or a lead-out wiring such as the individual wiring 91 and the common wiring 92 are interposed between the piezoelectric layer 70 and immediately above the piezoelectric layer 70. Needless to say, other materials in addition to an electrode or a lead-out wiring may be interposed between the piezoelectric layer 70 and immediately above the piezoelectric layer 70.

In this way, in the embodiment, the driving circuit 31 and the piezoelectric actuator 300 can be electrically connected to each other by directly bonding the driving circuit board 30, on which the driving circuit 31 is formed, to the channel formation substrate 10, and thus, it is possible to reliably connect the piezoelectric actuator 300 which is disposed at high density and the driving circuit 31 with low cost.

Figure 7:
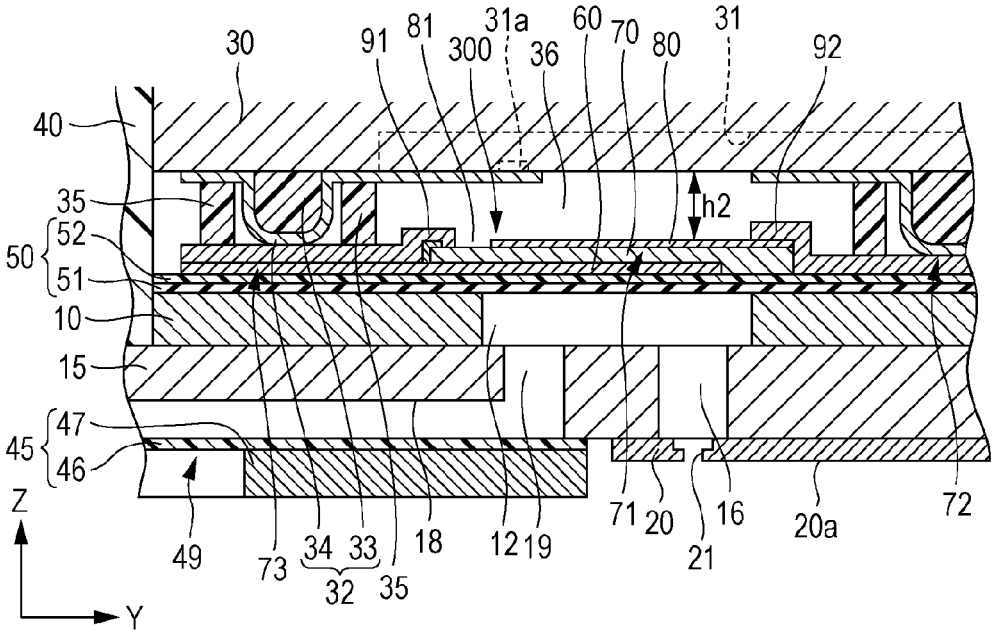
FIG. 7 is a sectional view illustrating Comparative Example of the head according to Embodiment 1.

In addition, the bump 32 which connects the first electrode 60 and the second electrode 80 of the piezoelectric actuator 300, and the driving circuit 31, and the adhesive layer 35 which bonds the driving circuit board 30 and the channel formation substrate 10 are provided above the piezoelectric layer 70, and thus the height of the holding portion 36 in the third direction Z can be set higher than, for example, an interval h1 between the second electrode 80 of the piezoelectric actuator 300 illustrated in FIG. 4 and the driving circuit board 30. In contrast, as illustrated in FIG. 7, in a case where the bump 32 and the adhesive layer 35 are not provided on the piezoelectric layer 70, but provided on the channel formation substrate 10, specifically, the individual wiring 91 and the common wiring 92 which are drawn onto the vibrating plate 50, an interval h2 between the second electrode 80 of the piezoelectric actuator 300 and the driving circuit board 30 is decreased. That is, in the embodiment, it is possible to make the interval h1 to be higher than the interval h2 by the thickness of the piezoelectric layer 70. Accordingly, it is possible to accommodate the piezoelectric actuator 300 in the holding portion 36 having a sufficient height, and thereby to prevent the piezoelectric actuator 300 from being displaced by coming in contact with the facing driving circuit board 30 even when the piezoelectric actuator 300 is displaced. In addition, in the embodiment, the height of the bump 32 and the adhesive layer 35 is not required to be high so as to secure the height of the holding portion 36, and thus a space for forming the bump 32 and the adhesive layer 35 with high height, thereby realizing size reduction. In addition, since the height of the holding portion 36 can be sufficiently secured, it is possible to sufficiently maintain the distance between the piezoelectric actuator 300 and the wiring such as the metallic film 34 which is provided on the driving circuit board 30. Therefore, it is less likely that a discharge is occurs due to a potential difference between the metallic film 34 and each electrode of the piezoelectric actuator 300 or the lead-out wiring. In this way, since the discharge is suppressed, it is possible to prevent the driving circuit 31 and the piezoelectric actuator 300 from being destroyed due to the discharge.

In addition, in the embodiment, the bump 32 and the adhesive layer 35 are provided on the same surface which is a surface of the individual wiring 91 and the common wiring 92, on one surface side on which the piezoelectric actuator 300 on the channel formation substrate 10 is provided. That is, the bump 32 and the adhesive layer 35 are provided on the same top surface on the one surface side of the channel formation substrate 10. Here, a state in which the bump 32 and the adhesive layer 35 are provided on the same top surface means that the bump 32 and the adhesive layer 35, which come in contact with each other on the channel formation substrate 10 side, have the same height in the third direction Z. In this way, when the bump 32 and the adhesive layer 35 are provided on the same top surface on the one surface side of the channel formation substrate 10, it is possible to reduce a load for pressing the driving circuit board 30 toward the channel formation substrate 10 side as small as possible. Therefore, it is possible to prevent the channel formation substrate 10 from being deformed and destroyed due to the load of the driving circuit board 30. In addition, it is possible to improve the long-term reliability of electrical connection.

A case member 40 which forms the manifold 100 communicating with the plurality of pressure generating chambers 12 is fixed to a bonding body formed of the channel formation substrate 10, the driving circuit board 30, the communicating plate 15, and the nozzle plate 20. The case member 40 is formed into the substantially the same shape as that of the communicating plate 15, and is bonded to the driving circuit board 30 and the aforementioned communicating plate 15. Specifically, the case member 40 includes a recessed portion 41 having a depth for accommodating the channel formation substrate 10 and the driving circuit board 30 on the driving circuit board 30 side. The recessed portion 41 includes an opening area larger than the surface of the driving circuit board 30, which is bonded to the channel formation substrate 10. In addition, in a state where the channel formation substrate 10 and the like are accommodated in the recessed portion 41, the opening surface of the recessed portion 41 on the nozzle plate 20 side is sealed by the communicating plate 15. In addition, the case member 40 is provided with a third manifold portion 42 having a recessed shape on both sides of the recessed portion 41 in the second direction Y. The third manifold portion 42, the first manifold portion 17 provided on the communicating plate 15, and the second manifold portion 18 constitute the manifold 100 of the embodiment.

As a material of the case member 40, for example, a resin or metal can be used. In addition, when a resin material is molded as the case member 40, it can be mass-produced at low cost.

In addition, the compliance board 45 is provided on the surface to which the first manifold portion 17 and the second manifold portion 18 of the communicating plate 15 are opened. The compliance board 45 seals the openings of the first manifold portion 17 and the second manifold portion 18 on the liquid ejection surface 20*a* side. Such a compliance board 45 is provided with a sealing film 46 and a fixing substrate 47 in the embodiment. The sealing film 46 is formed of a thin film having flexibility (for example, a thin film having a thickness of 20 μm or less, which is formed of polyphenylene sulfide (PPS), the stainless steel (SUS), or the like), and the fixing substrate 47 is formed of a hard material formed of metal such as the stainless steel (SUS). The area of the fixing substrate 47 which faces the manifold 100 becomes an opening portion 48 which is completely removed in the thickness direction, and thus one surface of the manifold 100 becomes a compliance portion 49 which is a flexible portion sealed by only the sealing film 46 having flexibility.

The case member 40 is provided an induction path 44 which communicates with the manifold 100 so as to supply ink to each of the manifolds 100. In addition, the case member 40 is provided with a connection port 43 to which the surface of the driving circuit board 30 on the side opposite to the channel formation substrate 10 is exposed and into which an external wiring (not shown) is inserted, and the external wiring inserted into the connection port 43 is connected to the driving circuit board 30.

In the ink jet recording head 1 having such a configuration, at the time of ejecting the ink, the inside of channel from the manifold 100 to the nozzle 21 is filled with the ink from a liquid storage portion for storing ink via an induction path 44. Thereafter, in response to a signal from the driving circuit 31, the voltage is applied to each of the piezoelectric actuator 300 corresponding to the pressure generating chamber 12, and thus the piezoelectric actuator 300 and the vibrating plate 50 are deformed to be bent. With this, the pressure in the pressure generating chamber 12 is increased and an ink droplet is ejected from a predetermined nozzle 21.

Other Embodiments

As described, one embodiment of the invention is described; however, a basic configuration of the invention is not limited.

In the above-described Embodiment 1, the bump 32 is provided on the driving circuit board 30; however, the invention is not necessarily limited to such a configuration. The bump 32 may not be provided on the channel formation substrate 10 side. That is, the bump 32 may be provided above the piezoelectric layer 70.

In addition, in the above-described Embodiment 1, the individual wiring 91 and the common wiring 92 are provided above the piezoelectric layer 70, and the bump 32 is connected to the individual wiring 91 and the common wiring 92; however, the invention is not limited thereto. For example, the bump 32 may be directly connected to the second electrode 80 without providing the common wiring 92. As described, when the plurality of bumps 32 is connected to the individual wiring 91 and the common wiring 92 which are provided above the piezoelectric layer 70, it is possible to suppress variation of the height when the bump 32 is connected, and thereby to ensurely perform the connection.

In addition, in the above-described Embodiment 1, as the bump 32, the core portion 33 a resin material having elastic properties and the metallic film 34 which is provided on the surface of the core portion 33 are used; however, the invention is not limited thereto. For example, as the bump 32, a metallic bump such as a solder or gold (Au), that is, the metallic bump may be used for the inner core portion. When the metallic bump is used as the bump 32, it is difficult to elastically deform the metallic bump. Therefore, the connection between the metallic bump and the individual wiring 91 and the common wiring 92 may be performed through soldering or brazing, eutectic bonding, welding, or bonding by using a conductive adhesive containing conductive particles (ACP or ACF) and a non-conductive adhesive (NCP or NCF). Meanwhile, in a case where the individual wiring 91 is disposed at a high density in accordance with the piezoelectric actuator 300 at high density, it is difficult to bond the individual wiring 91 and the bump 32 through the soldering, and thus it is preferable that the individual wiring 91 and the bump 32 are directly bonded to each other or are bonded to each other by using the conductive adhesive or the non-conductive adhesive. Here, in a case where warpage or undulation occurs on the channel formation substrate 10 or the driving circuit board 30, the metallic bump is not easily deformed in accordance with the warpage or undulation. Thus, it is likely that the connection failure occurs as compared with the bump 32 using the core portion 33 made of a resin having elastic properties as in the Embodiment 1 described above.

In addition, in the above-described Embodiment 1, the bump 32 and the adhesive layer 35 provided above the piezoelectric layer 70, that is, on the same plane which is a top surface of the individual wiring 91 and the common wiring 92; however, the invention is not limited to the configuration that the bump 32 and the adhesive layer 35 are provided above the piezoelectric layer 70. For example, the bump 32 and the adhesive layer 35 may be provided on the same plane in an area in which the piezoelectric layer 70 is not provided on the channel formation substrate 10. In addition, it is possible to secure the height of the holding portion 36 in the third direction Z by providing the bump 32 and the adhesive layer 35 on the same plane of a film other than the piezoelectric layer 70. In this way, when the bump 32 and the adhesive layer 35 are provided on the same plane even in an area in which the piezoelectric layer 70 is not provided, it is possible to reduce a load for pressing the driving circuit board 30 toward the channel formation substrate 10 side as small as possible. Therefore, it is possible to prevent the channel formation substrate 10 from being deformed and destroyed due to the load of the driving circuit board 30. In addition, it is possible to improve the long-term reliability of electrical connection.

Further, in the above-described Embodiment 1, the first electrode 60 is set to be the individual electrode in each of the active portions 71, and the second electrode 80 is set to be the common electrode of the plurality of active portions 71; however, the invention is not limited thereto. For example, the first electrode may be set to be the common electrode of the plurality of active portions, and the second electrode may be set to be the individual electrode in each of the active portions. In addition, in the above-described Embodiment 1, the vibrating plate 50 is formed of the elastic film 51 and the insulator film 52; the invention is not particularly limited thereto. For example, the vibrating plate 50 may include any one of the elastic film 51 and the insulator film 52, and the vibrating plate 50 may include other films. In addition, the vibrating plate 50 may serve as the vibrating plate only with the first electrode 60, without providing the elastic film 51 and the insulator film 52. Further, the piezoelectric actuator 300 may substantially serve as the vibrating plate.

In addition, in the above-described Embodiment 1, the driving circuit 31 is provided on the surface of the driving circuit board 30, which is opposite to the surface facing the channel formation substrate 10; however, the invention is not limited thereto. For example, the driving circuit may be provided on the surface of the driving circuit board 30, which is opposite to the surface facing the channel formation substrate 10. In this case, regarding the bump and the driving circuit, a through electrode which is provided by passing through the driving circuit board 30 in the third direction Z which is the thickness direction, for example, a silicon through electrode (TSV) is provided such that the driving circuit and the bump are connected to each other via the through electrode.

In addition, in the above-described Embodiment 1, the driving circuit board 30 which is provided with the driving circuit 31 formed through a semiconductor process; however, the invention is not limited thereto. For example, the driving circuit board 30 may be not provided with a switching element such as a transmission gate. That is, the driving circuit board 30 may not be provided with the switching element, but may be provided with a wiring to which a driving circuit (IC) is connected. In other words, regarding the driving circuit board 30, the invention is not limited to the configuration that the driving circuit 31 is integrally formed through the semiconductor process.

Figure 8:
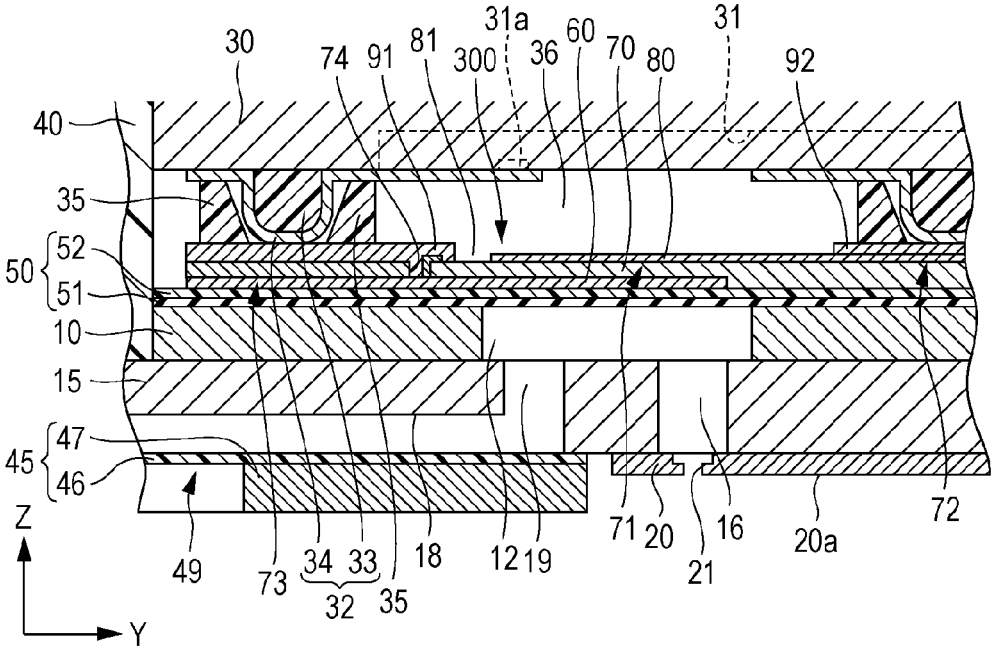
FIG. 8 is an enlarged sectional view illustrating a main portion of a head according to other embodiments.

In addition, in the above-described Embodiment 1, the adhesive layer 35 is provided to be the same width in the third direction Z; however, the invention is not particularly limited. Here, FIG. 8 illustrates other examples of the adhesive layer illustrate. In addition, FIG. 8 also illustrates Modification Example of the adhesive layer relating to other embodiments (an enlarged sectional view of a main portion).

As illustrated in FIG. 8, the adhesive layer 35 bonding the channel formation substrate 10 and the driving circuit board 30 overlap a portion of the bump 32 in a connecting direction of the bump 32, that is, in the third direction Z. Specifically, the width the adhesive layer 35 in the second direction Y extends to the extent that the connection between the bump 32 and the individual wiring 91 on the channel formation substrate 10 side is not disturbed. That is, in the embodiment, the adhesive layer 35 is formed into a trapezoid type in which the width of a cross-section, that is, the width of a sectional shape in the second direction Y is wide on the channel formation substrate 10 side, and is narrow on the driving circuit board 30 side. In this way, when the adhesive layer 35 and the bump 32 overlap with each other in the third direction Z, the adhesive area of the adhesive layer 35 is enlarged, and thus it is possible to enhance the bonding strength between the channel formation substrate 10 and the driving circuit board 30. In addition, in the embodiment, since a bonding area of the adhesive layer 35 is extended toward the bump 32 to the extent that the connection between the bump 32 and individual wiring 91 is not disturbed, it is possible to realize the size reduction as compared with a case where the adhesive layer 35 is extended to the side opposite to the bump 32. In addition, although not particularly illustrated in the drawings, the same configuration is applicable to the adhesive layer 35 in the common wiring 92, and thus it is possible to further enhance the bonding strength between the channel formation substrate 10 and the driving circuit board 30.

Further, in the above-described Embodiment 1, the adhesive layer 35 is also provided in both sides of the bump 32, which connects the driving circuit 31 and the common wiring 92, in the second direction Y; however, the invention is not limited thereto. For example, the adhesive layer 35 may not be provided on both sides of the bump 32 which is connected to the common wiring 92. Even such a case, in the above-described Embodiment 1, since the adhesive layer 35 is provided on both sides of the bump 32, which is connected to the individual wiring 91, the bump 32 and the common wiring 92 can be ensurely connected to each other without the adhesive layer 35 on both sides of the bump 32, which is connected to the common wiring 92, in the second direction Y.

In addition, in the above-described Embodiment 1, one driving circuit board 30 is provided with respect to one channel formation substrate 10; however, the invention is not limited thereto. For example, the driving circuit board 30 may be independently provided for each row of the piezoelectric actuator 300. In this regards, as described Embodiment 1, when providing one driving circuit board 30 with respect to one channel formation substrate 10, it is possible to reduce the number of components, and the connection between the common wiring 92 and the driving circuit board 30 can be commonly performed on two rows of the piezoelectric actuator 300, thereby reducing the connection places. Accordingly, as described Embodiment 1, when providing one driving circuit board 30 with respect to one channel formation substrate 10, it is possible to reduce the cost.

Further, in the above-described Embodiment 1, the configuration in which two rows of the piezoelectric actuator 300 are provided in the second direction Y; however, the number of row of the piezoelectric actuator 300 is not particularly limited. For example, it may be one row, or three or more rows.

Figure 9:
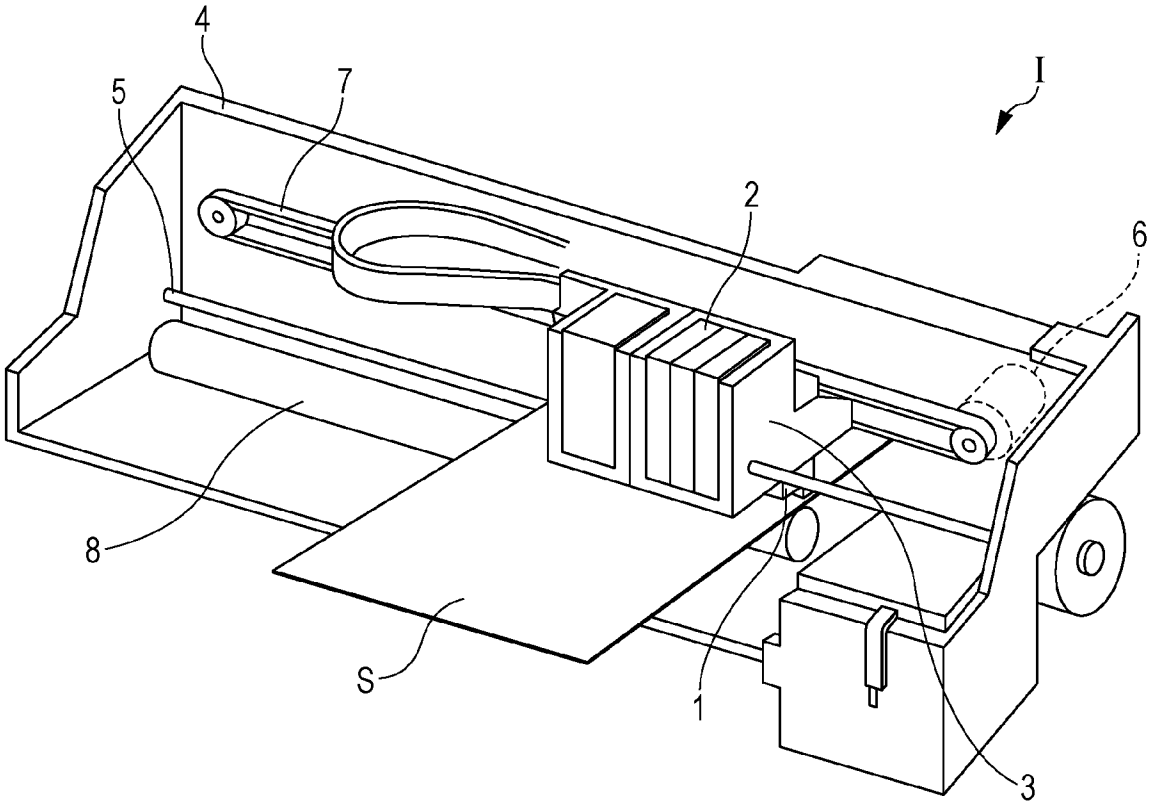
FIG. 9 is schematic diagram of a recording apparatus according to one embodiment.

In addition, the ink jet recording head 1 in these embodiments forms a portion of an ink jet recording head unit which is provided with an ink flow path communicating an ink cartridge or the like, and is mounted on the ink jet type recoding apparatus. FIG. 9 is a schematic diagram illustrating an example of the ink jet type recoding apparatus.

In an ink jet type recoding apparatus I as illustrated in FIG. 9, the ink jet recording head 1 is provided with a detachable cartridge 2 forming a supply unit, and a carriage 3 which is mounted on the ink jet recording head 1 is provided to be freely movable in the axial direction of a carriage axis 5 attached to an apparatus main body 4.

In addition, when a driving force of a driving motor 6 is transferred to the carriage 3 via a plurality of gears (not shown) and the timing belt 7, the carriage 3 mounted on the ink jet recording head 1 is moved along the carriage axis 5. On the other hand, a transporting roller 8 is provided in the apparatus main body 4 as a transporting unit, and a recording sheet S which is a recording medium such as a sheet is transported by the transporting roller 8. Meanwhile, the transporting unit that transports the recording sheet S may be a belt or a drum without being limited to the transporting roller.

In addition, in the above-described ink jet type recoding apparatus I, the ink jet recording head 1 is mounted on the carriage 3 and moved in a main scanning direction; however, a configuration of the ink jet type recoding apparatus I is not particularly limited thereto. For example, a so-called line-type recording apparatus, which performs printing such that the ink jet recording head 1 is fixed and the recording sheet S such as a sheet is moved in a sub scanning direction, is applicable to the invention.

In addition, in the above-described example, the ink jet type recoding apparatus I has a configuration that the cartridge 2 which is a liquid storage portion is mounted on the carriage 3; however, a configuration of the ink jet type recoding apparatus I is not particularly thereto. For example, a configuration such that the liquid storage portion such as an ink tank is fixed to the apparatus main body 4, and the storage portion and the ink jet recording head 1 are connected to each other via a supply tube such as a tube may be employed. In addition, the liquid storage portion may not be mounted on the ink jet type recoding apparatus.

In addition, the invention relates to a broadly general head, for example, the invention is applicable to various types of ink jet recording heads used in an image recording apparatus such as a printer, a color material ejecting head used for manufacturing a color filter such as a liquid crystal display, an electrode material ejecting head used for forming electrodes such as such as an organic EL display and a field emission display (FED), and a bioorganic material ejecting head used to manufacture a bio chip.

What is claimed is:

1. A head comprising:

a channel formation substrate that is provided with a pressure generating chamber which communicates with a nozzle for ejecting a liquid;

a piezo element that includes a first electrode which is provided on one surface side of the channel formation substrate, a piezoelectric layer which is provided on the first electrode, a second electrode which is provided on the piezoelectric layer, an active portion which is a portion of the piezoelectric layer in which a piezoelectric strain occurs by applying a voltage to the first electrode and the second electrode, and a non-active portion which is a portion of the piezoelectric layer in which piezoelectric strain does not occur when applying a voltage to the first electrode and the second electrode;

a driving circuit board that is located at the one surface side of the channel formation substrate, and is provided with a driving circuit for driving the piezo element; and an adhesive layer provided at the non-active portion between the channel formation substrate and the driving circuit board, wherein the piezo element and the driving circuit are electrically connected to each other via a plurality of bumps which are provided on any one of the channel formation substrate and the driving circuit board at the non-active portion, and wherein the plurality of bumps and the adhesive layer are provided above the piezoelectric layer of the piezo element and the adhesive layer is extended along both sides of each of the plurality of bumps that are arranged in a first direction so as to define a first region that encloses each of the plurality of bumps and a second region that encloses the active portion of the piezoelectric layer, at a plan view of the channel formation substrate, the first region and the second region being separated by the adhesive layer.

2. The head according to claim 1, wherein the first electrode, the second electrode, and a lead-out wiring which is drawn from the first electrode or the second electrode are provided on the piezoelectric layer on which the plurality of bumps is provided, and the plurality of bumps, the first electrode, the second electrode, and a lead-out wiring which is drawn from the first electrode or the second electrode are electrically connected to each other.

3. A liquid ejecting apparatus comprising the head according to claim 2.

4. The head according to claim 1, wherein the adhesive layer is formed of a photosensitive resin.

5. A liquid ejecting apparatus comprising the head according to claim 4.

6. The head according to claim 1, wherein each of the plurality of bumps include a core portion having elastic properties, and a metallic film which is provided on a surface of the core portion.

7. A liquid ejecting apparatus comprising the head according to claim 6.

8. A liquid ejecting apparatus comprising the head according to claim 1.

9. A head comprising:

a channel formation substrate that is provided with a pressure generating chamber which communicates with a nozzle for ejecting a liquid;

a piezo element that includes a first electrode which is provided on one surface side of the channel formation substrate, a piezoelectric layer which is provided on the first electrode, a second electrode which is provided on the piezoelectric layer, an active portion which is a portion of the piezoelectric layer in which a piezoelectric strain occurs by applying a voltage to the first electrode and the second electrode, and a non-active portion which is a portion of the piezoelectric layer in which piezoelectric strain does not occur when applying a voltage to the first electrode and the second electrode;

a driving circuit board that is located at the one surface side of the channel formation substrate, and is provided with a driving circuit for driving the piezo element; and an adhesive layer provided at the non-active portion between the channel formation substrate and the driving circuit board, wherein the piezo element and the driving circuit are electrically connected to each other via a plurality of bumps which are provided on any one of the channel formation substrate and the driving circuit board at the non-active portion, and wherein the plurality of bumps and the adhesive layer are provided on the same plane on the one surface side of the channel formation substrate and the adhesive layer is extended along both sides of each of the plurality of bumps that are arranged in a first direction so as to define a first region that encloses each of the plurality of bumps and a second region that encloses the active portion of the piezoelectric layer, at a plan view of the channel formation substrate.

10. A liquid ejecting apparatus comprising the head according to claim 9.

* * * * *